US005960958A

United States Patent [19]

Michaud et al.

[11] Patent Number: 5,960,958

[45] Date of Patent: Oct. 5, 1999

[54] CABLE TRAY PACKAGING

[75] Inventors: Serge R. Michaud, Brossard; Jean-Pierre Dutrisac, Iberville, both of Canada; Dick Brown, Eagan, Minn.

[73] Assignee: Thomas & Betts Corporation, Memphis, Tenn.

[21] Appl. No.: 08/864,336

[22] Filed: May 28, 1997

[51] Int. Cl.[6] ..... B65D 19/00

[52] U.S. Cl. ..... 206/599; 206/518; 206/453; 108/51.11

[58] Field of Search ..... 206/597, 599, 206/386, 451, 518, 453; 108/51.11

[56] References Cited

U.S. PATENT DOCUMENTS

| | | | |
|---|---|---|---|
| 2,004,626 | 6/1935 | Hann | 206/597 |
| 2,526,228 | 10/1950 | Hammer . | |
| 2,614,689 | 10/1952 | Miller . | |
| 2,675,936 | 4/1954 | Ridge . | |
| 2,741,361 | 4/1956 | Klein | 206/599 |
| 3,097,741 | 7/1963 | Schwartz | 206/599 |
| 3,100,046 | 8/1963 | Wetmore et al. | 206/597 |
| 3,273,706 | 9/1966 | Bundy . | |
| 3,616,899 | 11/1971 | Blackman | 206/597 |
| 3,880,286 | 4/1975 | Wegener . | |
| 4,050,664 | 9/1977 | Daley . | |
| 4,148,394 | 4/1979 | Bederman . | |
| 4,317,517 | 3/1982 | Tisdale . | |
| 4,467,922 | 8/1984 | Rowley . | |
| 4,694,962 | 9/1987 | Taub | 206/386 |
| 5,076,175 | 12/1991 | Whatley, II | 108/51.11 |

FOREIGN PATENT DOCUMENTS

| | | |
|---|---|---|
| 0 574 970 | 12/1993 | European Pat. Off. . |
| 1332675 | 11/1963 | France . |
| 26 31 817 | 1/1978 | Germany . |

*Primary Examiner*—Paul T. Sewell
*Assistant Examiner*—J. Mohandesi
*Attorney, Agent, or Firm*—Hoffmann & Baron, LLP

[57] ABSTRACT

A palletized bundle of stacked elongate cable trays includes a pair of endcaps placed over each longitudinal end of the stack of cable trays. The endcaps are each cinched by a shipping strap to pallet spacer skids provided under each endcap. Each pallet spacer skid accommodates the lifting tines of a forklift. The pallet spacer skids also provide sufficient ground clearance to allow the palletized cable trays to be transversely engaged by the lifting tines of a forklift. The palletizing package may also include protective liners placed between the shipping strap and the stack of cable trays to further protect the cable trays from damage by the cinched shipping strap.

20 Claims, 4 Drawing Sheets

CABLE TRAY PACKAGING

FIELD OF THE INVENTION

The present invention relates to packaging devices for cable trays or the like. More particularly, the present invention relates to an assembly for palletizing bundles of stacked elongate cable trays.

BACKGROUND OF THE INVENTION

Cable trays are used extensively in the construction industry for running the various cables used in a building along certain predetermined paths. Cable trays may, for example, be suspended from a ceiling or mounted to walls so that the various wires and cables used in the building may be laid therein for a more orderly and accessible placement. Typically, a particular construction project requires a variety of cable trays of different shapes and sizes to accommodate the particular layout for the cable tray system. Because each project may require its own unique variety of cable trays, there is no generally accepted or standard shipping configuration or load-out for cable trays.

Due to the lack of a standard method of packaging cable a cable tray for shipment, cable trays are typically shipped in bundles having a matrix of one or more rows of cable trays stacked one on top of the other. Cable trays may also be arranged so that pairs of cable trays are interwoven in facing engagement and the pairs then stacked in a number of rows and columns. Further, bundles of cable trays may include cable trays having a variety of shapes and sizes. Each bundle is typically wound only with shipping straps. These bundles of cable trays can therefore be very difficult to handle without damaging the cable trays. Often, damage to a bundle of cable trays occurs because the bundles get dragged, pushed or pulled during the various transfers among shipping or storage trailers.

The use of pallets to ease the handling and transferring of bulk packages is well known. A pallet typically provides cargo with vertical separation from the ground so that a forklift or crane may lift the entire bundle all at once. A pallet can also provide containment of the cargo itself. One drawback of pallets, once constructed, is that until they are utilized with cargo they tend to take up valuable warehouse space. Also, once used, the pallets are often not returned or reused in the packaging or shipping of another item. As a result, the construction and storage of pallets adds costs for both the shippers and receivers. It is therefore desirable that palletizing units have low construction costs and provide easy storage.

Packaging pallets are known in the prior art.

U.S. Pat. No. 2,526,228 to Hammer discloses a packaging used to palletize a stack of flat sheets or panels. Two rows of longitudinally and transversely aligned skids are each stapled to a strap used to bind the stack. The stack is then placed or built on top of the skids so that the skids are centered underneath. The longitudinal straps are then bound around the stack to hold the skids thereto. Additional straps are then cinched transversely around the stack between each of the transversely aligned skids to further secure the stack. Such packaging, however, does not account for a stack of articles in matrix form as may be encountered with cable trays. Should the stack consist of more longitudinal rows than provided by the spacers, an interior row of cable trays could slide free of the pallet. Furthermore, the Hammer patent does not provide for the longitudinal engagement of a palletized stack that is more than twice as long as the tines of the forklift.

U.S. Pat. No. 4,317,517 to Tisdale discloses a palletizing assembly for a stack of flat sheets or panels utilizing two-piece spacers. Each spacer is formed from a length of laminated paper having an M-shape being inserted into a length of laminated paper having a U-shape. The stack is placed or built on top of a plurality of so-formed spacers. The spacers lie so that the bottom of the U-shaped piece engages the stack while the single groove presented by the M-shaped piece lies along the ground. A strap is run along the groove of each spacer and cinched around the stack. The pallet formed in this manner, however, fails to engage and secure any articles lying in the interior of a matrix stack such as may be found with bundled cable trays. The Tisdale patent also fails to provide a pallet which may be longitudinally engaged by the tines of a forklift.

It is therefore desirable to provide a palletizing package for a matrix stack of cable trays that longitudinally restrains each cable tray in the stack while also allowing engagement of the palletized stack from the transverse and longitudinal direction by the tines of a forklift.

SUMMARY THE INVENTION

It is therefore an object of the present invention to provide a packaging for a bundle of longitudinally stacked cable trays that reduces the incidence of damage to the cable trays during shipping and handling.

It is another object of the present invention to provide a packaging for a bundle of longitudinally stacked cable trays that improves the handling characteristics of the cable trays bundled for shipment.

It is yet another object of the present invention to provide a packaging for a bundle of longitudinally stacked cable trays that allow the stacked cable trays to be engaged by a forklift at either end or side of the stack of cable trays.

It is a further object of the present invention to provide a packaging for a bundle of longitudinally stacked cable trays that can be cheaply and easily built and stored when not in use.

In the efficient attainment of these and other objects the present invention provides a palletizing package for a number of stacked elongate cable trays including a pair of endcaps placed over each longitudinal end of the stack of cable trays. The endcaps are each cinched by a shipping strap to pallet spacer skids provided under each endcap. Each pallet spacer skid accommodates the lifting tines of a forklift. The pallet spacer skids also provide sufficient ground clearance to allow the palletized cable trays to be transversely engaged by the lifting tines of a forklift. The palletizing package may also include protective liners placed between the shipping strap and the stack of cable trays to further protect the cable trays from damage by the cinched shipping strap.

DETAILED DESCRIPTION OF THE INVENTION

Figure 2:
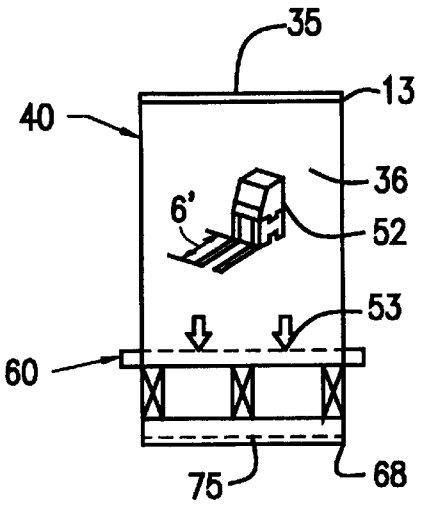
FIG. 2 is an front view of the pallet of the present invention and is illustrative of the information provided by the endcaps.
Figure 1:
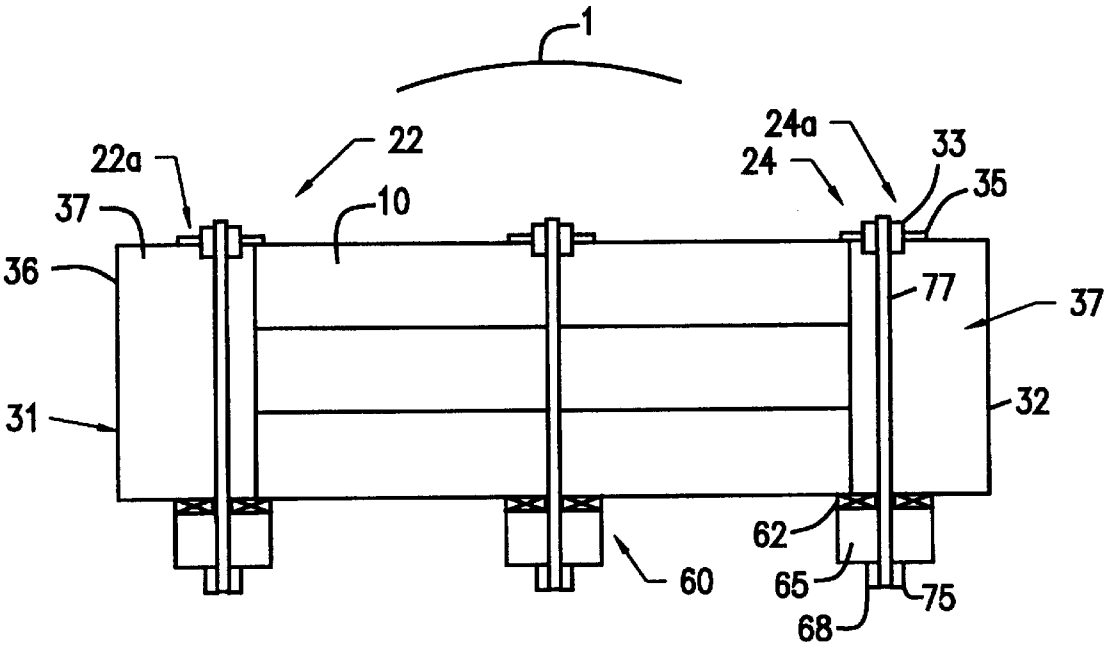
FIG. 1 is a side view of an embodiment of the present invention utilizing three pallet spacer skids to support a stack of cable trays.

As shown in FIGS. 1 and 2, the present invention is directed to supporting a cable tray bundle 10 in a palletized assembly 1 for movement by a forklift or other warehouse moving device (not shown).

Figure 5:
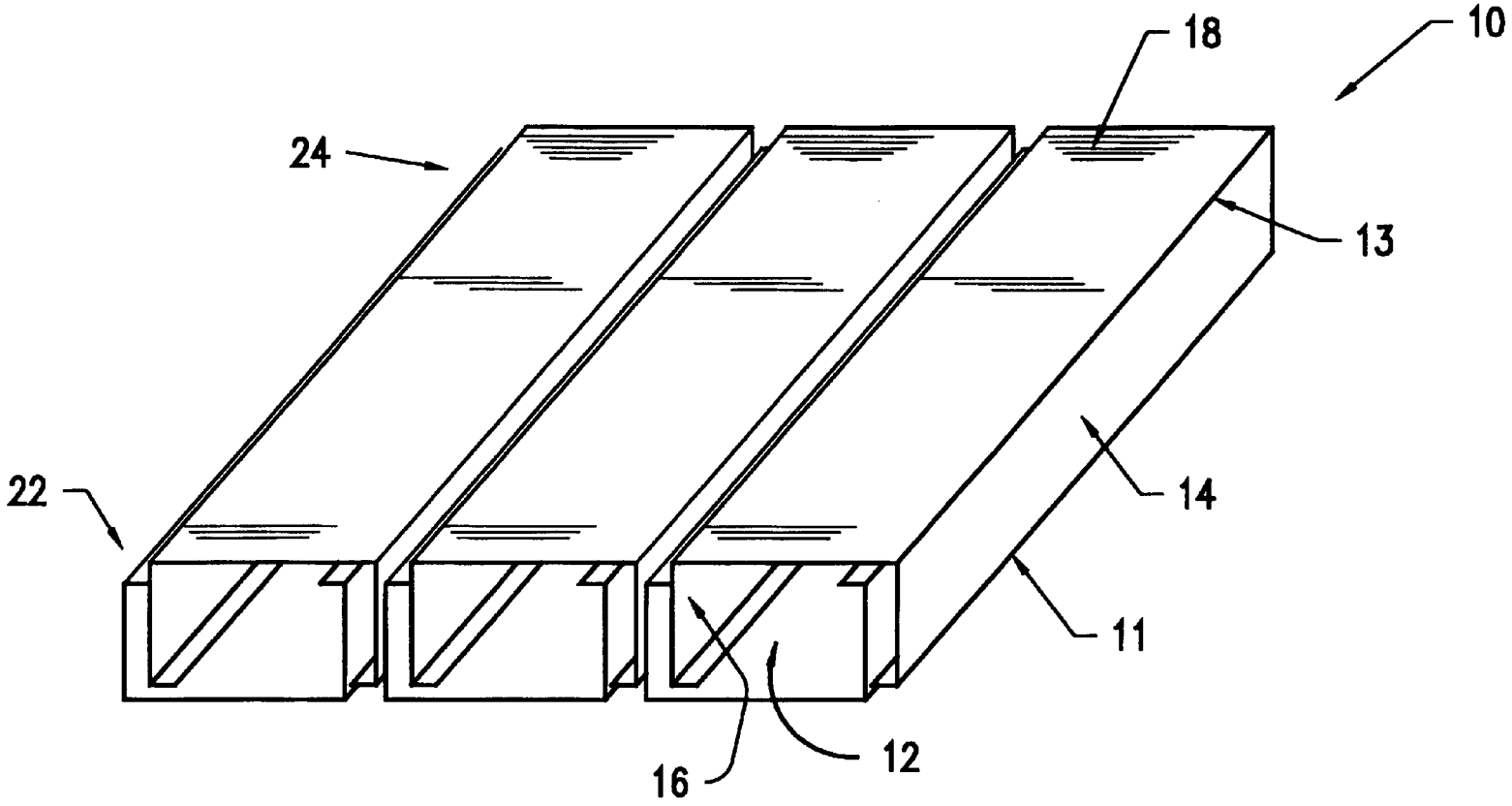
FIG. 5 is an isometric view of a row of pairs of cable trays in a shipping configuration.

As shown in FIG. 5, cable tray bundle 10 may include a number of individual cable trays 11 having a generally trough-like longitudinal shape with open ends 12. The cable trays generally include a pair of transversely spaced side walls 14, 16 connected by a cable support platform 18 spanning therebetween. Cable tray bundle 10 may be typically arranged by fitting together in an opposing and offset manner pairs of cable trays 11 so that one of the side walls of each cable tray is positioned between the two side walls of the opposing cable tray. The cable tray bundle 10 may include cable trays 11 arranged in a number of stacked rows of cable trays. The height and width of cable tray bundle 10 may be varied as dictated by a particular use.

Referring again to FIGS. 1 and 2, the present invention provides endcaps 31, 32 over each longitudinal end 22, 24 of the cable try bundle 10 of stacked cable trays 11. Each endcap 31, 32 includes a planar end-piece 36 positioned transversely across one longitudinal end 22, 24 of the cable tray bundle 10 and further includes a side wall 37 which perimetrically bounds and extends from planar end-piece 36. The side wall 37 and end-piece 36 of the endcap thus defines an open ended rectangular container which allows each endcap 31, 32 to fit over the longitudinal ends 22, 24 of the cable tray bundle 10 of cable trays 11. A portion of each endcap 31, 32 extends over an end extent 22*a*, 24*a*of cable tray bundle 10. The endcaps 31, 32 preferably provide handling instructions 52, 53 in the form of written and graphic indicia visible to the workers shipping and handling the palletized assembly 1. While each component of the endcaps 31, 32 may be separately formed and assembled, the endcaps 31, 32 are preferably formed from a single sheet of thick cardboard, or the like, formed into the rectangular container configuration shown herein.

Figure 3:
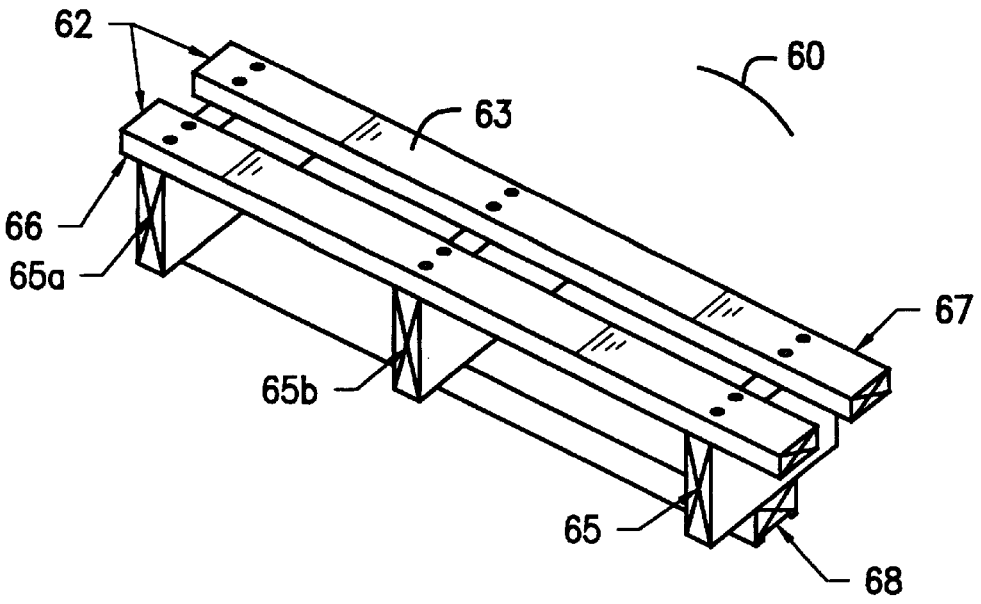
FIG. 3 is an isometric view of a pallet spacer skid of the present invention.
Figure 4:
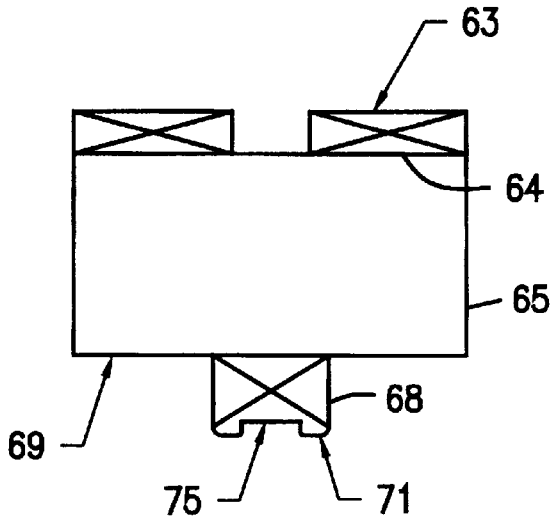
FIG. 4 is a side view of a pallet spacer skid of the present invention.

The cable tray bundle 10 of cable trays 11 is supported over a plurality of pallet spacer skids 60. Referring additionally to FIGS. 3 and 4, the pallet spacer skid 60 of the present invention is an elongate member formed of wood or other suitable rigid material. Each pallet spacer skid 60 generally includes a pair of parallel flat upper cleats 62. Each cleat 62 includes an upper surface 63 and an opposed lower surface 64. The cable tray bundle 10 of cable trays 11 rest upon upper surfaces 63 of cleats 62. Cleats 62 are joined by spaced-apart spacer blocks 65 attached to lower surfaces 64. In the preferred embodiment, three spacer blocks 65 are shown. End spacer blocks 65*a*are positioned offset from the opposed longitudinal ends 66 of cleats 62 while center spacer block 65*a*is centrally located along cleats 62. Each block 65 is rigidly fixed to lower surfaces 64 of each upper cleat 62 as by nailing, stapling, gluing, or the like, with the spacer blocks 65 disposed transversely across the upper cleats 62 in flush transverse edge relationship therewith. Spacer blocks 65 are spaced apart longitudinally along cleats 62 a distance sufficient to accommodate the passage of the tines of a forklift (not shown) therebetween.

Pallet spacer skid 60 further includes a lower cleat 68 attached to surface 69 of spacer blocks 65, opposite cleats 62. Cleat 68 is centrally located across spacer blocks 65, in flush longitudinal edge relationship therewith. Cleat 68 includes a longitudinal channel 75 milled the length thereof. Channel 75 is generally U-shaped and opens in a downwardly directed fashion. Channel 75 accommodates a length of binding strap 77 which is used to secure the cable tray bundle 10 to pallet spacer skid 60 (FIG. 1).

Figure 6:
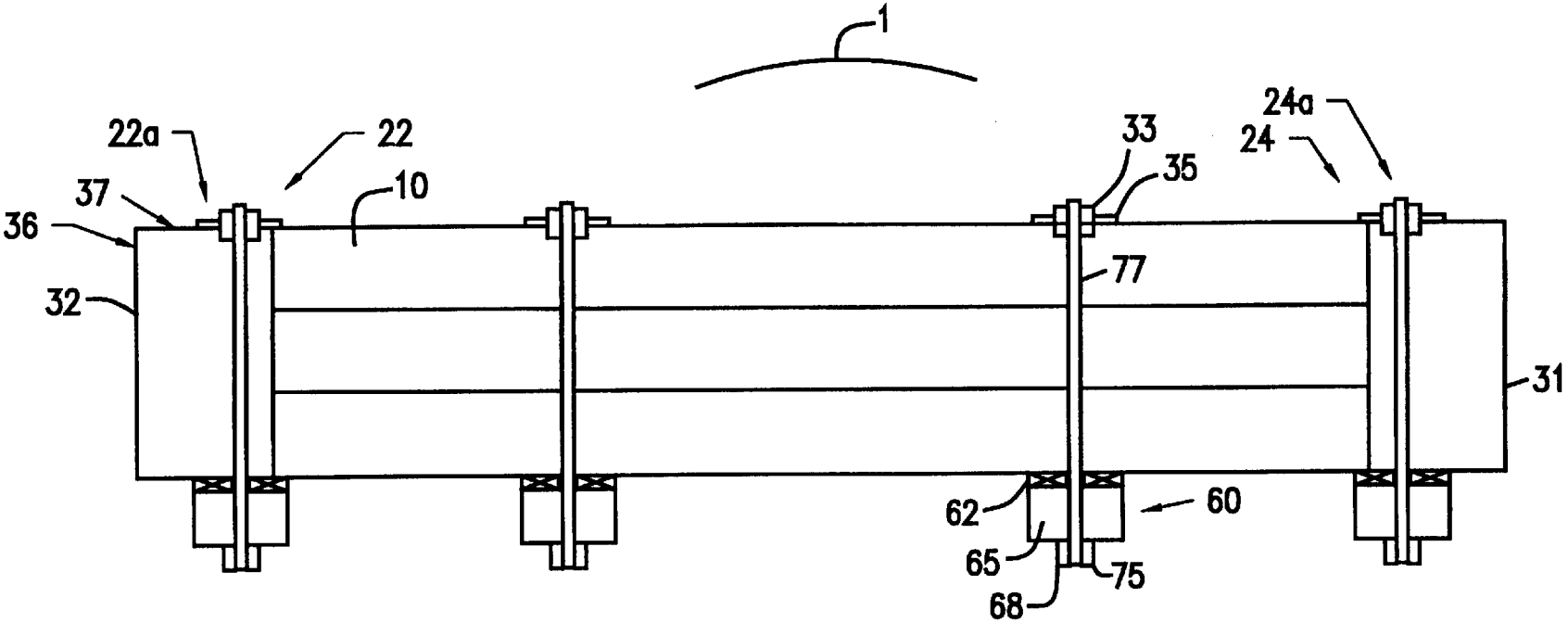
FIG. 6 is a side view of the palletizing package of the present invention utilizing four spacer skids to support a stack of cable trays.

Referring again to FIGS. 1 and 2, strap 77 is of the type conventionally used for strapping purposes. Straps 77 may be placed around cable tray bundle 10 and around pallet spacer skid 60 being retained by channel 75. Channel 75 also serves to hold strap 77 in place during shipment and handling of palletized assembly 1. In preferred configuration, pallet spacer pallet spacer skids 60 is positioned under each of the longitudinal ends 22, 24 of bundle 20 as well as at a central location along cable tray bundle 10. Other configurations are also contemplated by the present invention. As shown in FIG. 6, additional pallet spacer skids 60 may be employed along the length of cable tray bundle 10. In each embodiment, the end pallet spacer skids 60 also are positioned to the strap 77 thereabout securing the end caps 31, 32 to the palletized assembly 1.

As shown in FIGS. 1 and 6, the present invention also contemplates placing angle inserts 33 on each exposed longitudinal edge 13 engaged by strap 77 to protect the cable trays 11 forming those edges 13 from damage by the straps 77. All pallet spacer skids 60 bound to the cable tray cable tray bundle 10 preferably include angle inserts 33 interposed therebetween at the exposed edges 13 of the cable tray bundle 10. Planar bundle liners 35 may also be interposed between the cable tray bundle 20 and the strap 77 to further protect the cable tray bundle 10 of cable trays 11. Furthermore, the upper cleats 62 on pallet spacer skid 60 may be transversely spaced from each other sufficiently to allow strap 77 to pass therebetween.

Various other modifications to the foregoing disclosed embodiments will now be evident to those skilled in the art. Thus, the particularly described preferred embodiments are intended to be illustrative and not limited thereto. The true scope of the invention is set forth in the following claims.

What is claimed is:

1. A palletized bundle of stacked elongate cable trays comprising:

a pair of spacedly-separated endcaps, each endcap being positioned over one end of said bundle of cable trays, each said endcap having a portion extending over a longitudinal end extent of said bundle;

a pair of spacedly separated elongate pallet skids, each pallet skid being positioned transversely across one of said end extents of said bundle and underlying said portion of said endcap, each said pallet skid defining a passage transversely through said skid for accommodating the tines of a forklift inserted along the length of said bundle; and a pair of binding straps, each binding strap surrounding said portion of said endcap and said skid for securing said ends of said bundle to said skid.

2. The palletized bundle of stacked elongate cable trays of claim 1 wherein each pallet skid further comprises a lower cleat having at least two pairs of longitudinally opposed surfaces and two opposing end surfaces.

3. The palletized bundle of stacked elongate cable trays of claim 2 wherein each pallet spacer skid further includes a plurality of spacer blocks spaced along one longitudinally opposed surface of said lower cleat.

4. The palletized bundle of stacked elongate cable trays of claim 3 wherein the number of spacer blocks spaced along the lower cleat is three.

5. The palletized bundle of stacked elongate cable trays of claim 3 including one spacer block located in flush longitudinal edge relationship at each transverse end of said lower cleat.

6. The palletized bundle of stacked elongate cable trays of claim 2 wherein each lower cleat includes a longitudinal channel along the surface opposite the spacer blocks, said channel to accommodate said shipping strap.

7. The palletized bundle of stacked elongate cable trays of claim 3 wherein each pallet spacer skid further includes an upper cleat across the surface of said spacer blocks opposite said lower cleat.

8. The palletized bundle of stacked elongate cable trays of claim 3 wherein each pallet spacer skid further includes plural upper cleats across the surface of said spacer block and said lower cleat.

9. The palletized bundle of stacked elongate cable trays of claim 8 wherein said upper cleats are in flush longitudinal edge relationship with the transverse ends of the spacer blocks.

10. The palletized bundle of stacked elongate cable trays of claim 8 wherein the ends of each upper cleat overhang the outermost spacer blocks.

11. The palletized bundle of stacked elongate cable trays of claim 8 wherein the upper cleats are laterally spaced to accommodate said shipping strap therebetween.

12. The palletized bundle of stacked elongate cable trays of claim 1 further comprising angle inserts placed between said shipping strap and said bundle, one angle insert straddling each exposed longitudinal edge of the bundle of cable trays.

13. The palletized bundle of stacked elongate cable trays of claim 1 wherein at least one endpiece of each endcap has operating directions printed thereon.

14. The palletized bundle of stacked elongate cable trays of claim 1 employing three pallet skids including one under each endcap and the third placed midway therebetween, said third pallet skid secured by a binding strap to the stack.

15. The palletized bundle of stacked elongate cable trays of claim 1 employing four pallet skids including one under each endcap and the remaining pallet skids evenly spaced therebetween, said remaining pallet skids each being secured by a binding strap to the stack.

16. A palletizing package for a number of elongate stacked cable trays comprising:

a pair of endcaps positioned in spaced separation over each longitudinal end of said stacked cable trays, each endcap including a planar endpiece, said planar endpiece being perimetrically bounded by a side wall extending outwardly therefrom, said side wall further defining a cavity accommodating each longitudinal end of said stacked cable trays;

a pallet spacer skid positioned adjacent each endcap, each pallet spacer skid including a lower cleat having at least two pairs of longitudinally opposed surfaces and two opposing end surfaces, a plurality of spacer blocks spaced along one longitudinally opposed surface of said lower cleat, said spacer blocks being generally parallelepiped shaped, and a plurality of upper cleats placed across the surface of said spacer blocks opposite said lower cleat, wherein said lower cleat, spacer blocks, and upper cleats define a number of passages therebetween for accommodating the lifting tines of a forklift; and a shipping strap assembly for fastening about each endcap and adjacent pallet skid, each shipping strap assembly including a shipping strap, a bundle liner placed between said shipping strap and the exposed edges of the stack of cable trays secured to the pallet spacer skids.

17. The palletizing package of claim 16 wherein the upper cleats are laterally spaced to accommodate said shipping strap therebetween.

18. The palletizing package of claim 16 wherein each lower cleat includes a longitudinal channel along the surface opposite the spacer blocks, said channel to accommodate said shipping strap.

19. The palletizing package of claim 16 wherein said upper cleats are in flush longitudinal edge relationship with the transverse ends of the spacer blocks.

20. The palletizing package of claim 16 wherein the ends of each upper cleat overhang the outermost spacer blocks.

* * * * *